US007082929B2

(12) United States Patent
Park

(10) Patent No.: US 7,082,929 B2
(45) Date of Patent: Aug. 1, 2006

(54) METHOD FOR DETERMINING AMOUNT OF FUEL INJECTION IN ENGINE SYSTEM

(75) Inventor: Jin-Hong Park, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/199,920

(22) Filed: Aug. 8, 2005

(65) Prior Publication Data

US 2006/0032481 A1 Feb. 16, 2006

(30) Foreign Application Priority Data

Aug. 11, 2004 (KR) ..... 10-2004-0063157

(51) Int. Cl.
*F02D 41/18* (2006.01)

(52) U.S. Cl. ..... 123/488; 73/118.2; 123/494

(58) Field of Classification Search ..... 123/488, 123/494; 73/118.2, 204

See application file for complete search history.

(56) References Cited

U.S. PATENT DOCUMENTS

| | | | | |
|---|---|---|---|---|
| 3,975,951 | A * | 8/1976 | Kohama et al. | 73/118.2 |
| 4,404,846 | A * | 9/1983 | Yamauchi et al. | 73/118.2 |
| 4,719,890 | A * | 1/1988 | Wataya et al. | 123/488 |
| 4,841,938 | A * | 6/1989 | Weibler et al. | 123/494 |
| 5,137,001 | A * | 8/1992 | Taniguchi | 123/494 |

* cited by examiner

*Primary Examiner*—T. M. Argenbright
(74) *Attorney, Agent, or Firm*—Morgan Lewis & Bockius LLP

(57) ABSTRACT

Determining a fuel injection amount of an engine system having a crank sensor and airflow sensor includes computing a speed change of engine revolutions per minute and computing a speed change of an intake-air amount. Comparing the speed change of the engine rpm and the speed change of the intake-air amount with reference values, and if vibration and reverse-flow are determined to occur in the intake manifold, correcting the intake-air amount into the present engine speed and computing the present intake-air amount. The fuel injection amount is then determined by using the above computed intake-air amount. This improves the accuracy of determining the credible range of the airflow sensor and increases the range using the airflow sensor.

7 Claims, 5 Drawing Sheets

METHOD FOR DETERMINING AMOUNT OF FUEL INJECTION IN ENGINE SYSTEM

CROSS-REFERENCE TO RELATED APPLICATIONS

The present application is based on, and claims priority from, Korean Application Ser. Number 10-2004-0063157, filed on Aug. 11, 2004, the disclosure of which is hereby incorporated by reference herein in its entirety.

FIELD OF THE INVENTION

The present invention relates to an engine system and, more particularly, to a method of determining the amount of fuel injection in response to the state of an airflow sensor.

BACKGROUND OF THE INVENTION

Typically an engine combusts fuel in a combustion chamber formed by the cylinder, cylinder head, and piston that reciprocates in the cylinder. Explosion force from the combustion rotates a crankshaft through a connecting rod that is connected to the piston and, thereby, converts thermal energy into mechanical energy. The combustion chamber is mounted with an intake pipe to provide the air-fuel mixture, and an exhaust pipe to discharge burned gas. The intake pipe is typically installed with a throttle valve and airflow sensor.

An Electronic Control Unit (ECU) is programmed to decide, according to an amount of air detected via an airflow sensor, an appropriate amount of fuel for activating the engine. However, if vibration and reverse-flow are generated in the intake pipe of the engine, the output value of the airflow sensor can be inaccurate. Therefore, the airflow sensor should first be diagnosed as to whether it is in a reliable state, and if not, the fuel amount should be determined regardless of the air amount measured via the airflow sensor.

SUMMARY OF THE INVENTION

Embodiments of the present invention provide improved accuracy in determining a credible range of an airflow sensor. The present invention also increases the range where the amount of fuel injection can be determined by using an outputted value from the airflow sensor.

According to another embodiment, a method determines the amount of fuel injection into an engine system having a crank sensor and airflow sensor. The method includes computing the speed change in engine revolutions per minute (rpm) by detecting the engine rpm from the crank sensor. Next the method computes the speed change of an intake-air amount by detecting the intake-air amount from the airflow sensor. The method then compares the speed change of the engine rpm and the speed change of the amount of intake-air with reference values, respectively. Thereafter, and Electronic Control Unit (ECU) decides whether the diagnosis of the generation of vibration and reverse-flow in an intake manifold is required. If the diagnosis for the generation of vibration and reverse-flow in the intake manifold is decided to be required, the method executes a pre-established determination logic for the vibration and reverse-flow and determines whether the vibration and reverse-flow are generated in the intake manifold. If the vibration and reverse-flow are determined to occur in the intake manifold, then the method corrects the intake-air amount, which is restored before generation of the vibration and reverse-flow, in response to the present engine speed. Next, the method computes the present intake-air amount and decides the fuel injection amount by using the above computed intake-air amount instead of using the intake-air amount measured by the airflow sensor.

If it is determined that no vibration and reverse-flow occur in the intake manifold, the fuel injection amount is preferably determined by using the value measured via the airflow sensor. If the speed change of the engine rpm or the speed change of the intake-air amount exceeds a pre-established relevant reference value, then the method diagnoses whether the vibration and reverse-flow are generated in the intake manifold. Thus, according to a preferred embodiment, the diagnosis of generation of the vibration and reverse-flow is performed only if necessary.

According to another embodiment, the speed change of engine rpm is preferably calculated by computing a changed amount of time by subtracting a previous timer value from a present timer value and then multiplying the result by a time conversion constant. Next, the method restores the present timer value as the previous timer value and computes a changed amount of engine rpm by subtracting a previous engine rpm from a present engine rpm measured from the crank sensor. The present engine rpm is restored to the previous engine rpm and the speed change of the engine rpm is computed by dividing the changed amount of engine rpm by the changed amount of time.

According to an embodiment, the speed change of the amount of intake-air is preferably calculated by computing a changed amount of time. The changed amount of time is computed by subtracting a previous timer value from a present timer value and then multiplying the result by a time conversion constant. Next the present timer value is restored to the previous timer value and a changed amount of intake-air is computed by subtracting a previously measured intake-air amount value from a present intake-air amount value measured via the airflow sensor. The present intake-air amount value is restored as the previous intake-air amount value and the speed change of the intake-air amount is computed by dividing the changed amount of intake-air by the changed amount of time.

Whether the diagnosis for the generation of the vibration and reverse-flow in the intake manifold will be performed is decided by comparing, on the basis of a pre-saved reference speed change table of the engine rpm, the above computed speed change of the engine rpm with a reference speed change of the engine rpm according to the engine rpm and engine load. Next, on the basis of a pre-saved reference speed change table of the intake-air amount, the above computed speed change of the intake-air amount is compared with a reference speed change of the intake-air amount according to the engine rpm and engine load. Thereafter, the method decides whether the diagnosis of the generation of vibration and reverse-flow in the intake manifold is required according to the result of the logical sum of each of the above comparisons. Thus, the diagnosis for the generation of the vibration and reverse-flow is performed only if necessary.

According to another embodiment, the determination of the generation of the vibration and reverse-flow in the intake manifold is preferably performed by determining whether a negative value is obtained when the speed change of the engine rpm is multiplied by a conversion constant that converts the speed change of the engine rpm into the speed change of the intake-air amount according to the driving state of an engine. Then the value is multiplied by the speed change of the intake-air amount. An absolute value of this value is obtained by subtracting the speed change of the intake-air amount from the multiplication of the speed change of the engine rpm with the conversion constant. Thereafter, the above absolute value is compared with an allowance value of the speed change of the engine rpm and the speed change of the intake-air amount according to the driving state of an engine. If the above multiplied value is a negative value and the absolute value is larger than the allowance value the method determines that the vibration and reverse-flow are generated in the intake manifold.

BRIEF DESCRIPTION OF THE DRAWINGS

For a better understanding of the nature and objects of the present invention, reference should be made to the following detailed description, read in conjunction with the accompanying drawings, in which.

DETAILED DESCRIPTION OF THE PREFERRED EMBODIMENTS

Figure 1:
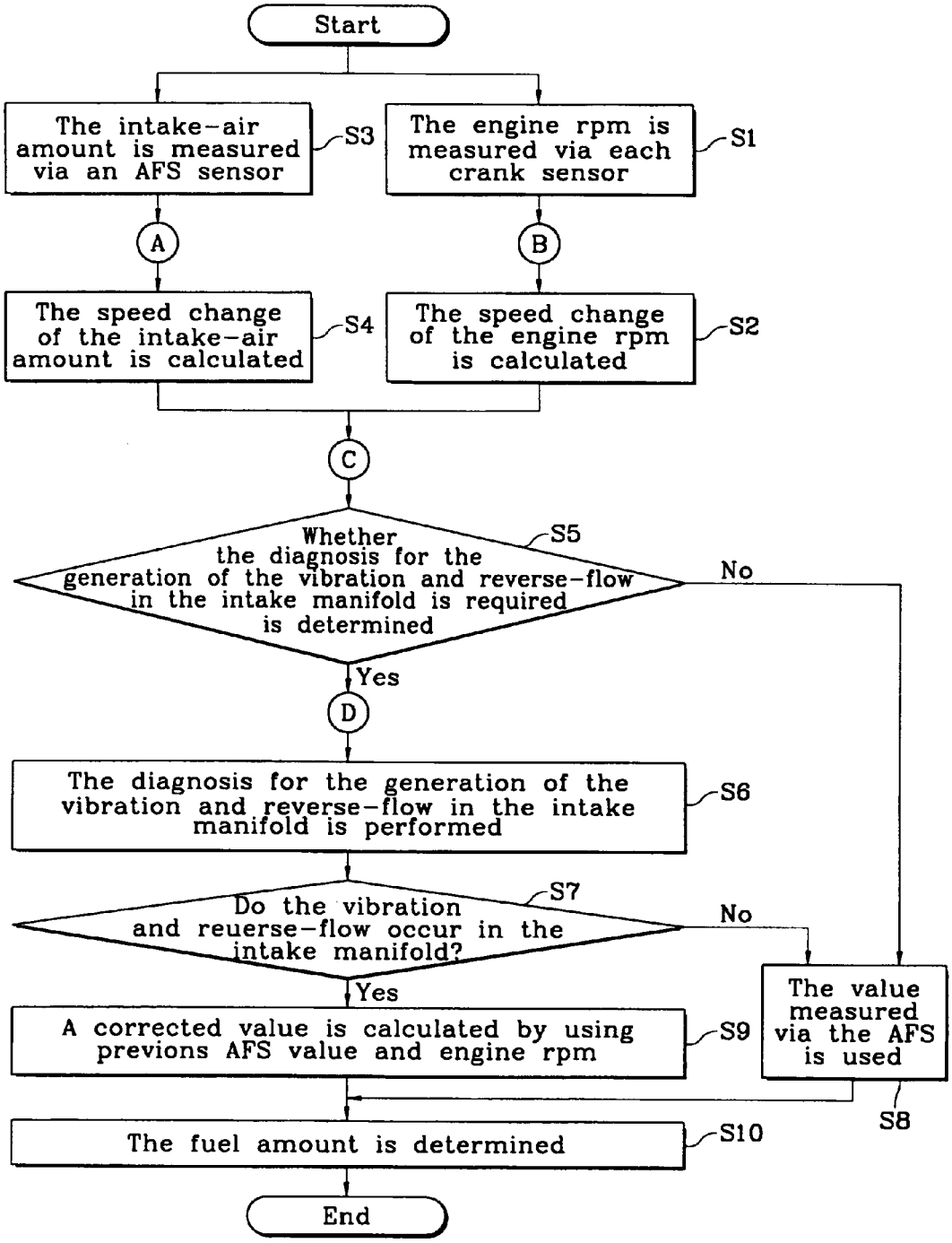
FIG. 1 is a flowchart of a method for determining an amount of fuel injection using an airflow sensor in an engine system according to an embodiment of the present invention.

As illustrated in FIG. 1, revolutions per minute (rpm) of an engine are detected from a crank sensor (S1). A speed change of the rpm is calculated (S2) according to an embodiment of the present invention. An intake-air amount is detected via an airflow sensor (AFS) (S3) and then the speed change of the intake-air amount is calculated (S4). The speed change of the engine rpm, as well as, the speed change of the intake-air amount are compared with the reference values, respectively, and whether a determination logic for the generation of vibration and reverse-flow in the intake manifold will be performed is determined (S5).

If the speed change of the engine rpm or the speed change of the intake-air amount exceeds the reference value as a result of step 5, a determination logic for the generation of the vibration and reverse-flow in the intake manifold is performed (S6). If the vibration and reverse-flow are determined to occur in the intake manifold from step 6 (S7), the intake-air amount (restored before the generation of the vibration and reverse-flow) is corrected to the present engine speed and the present intake-air amount is calculated (S9). Next, the fuel-injection amount is determined by using the above calculated intake-air amount instead of using the intake-air amount measured by the AFS (S10). However, if it is determined that no vibration and reverse-flow are generated in the intake manifold in step 7, the amount of fuel injected in step 10 is determined by using a value measured via the AFS (S8).

Figure 2:
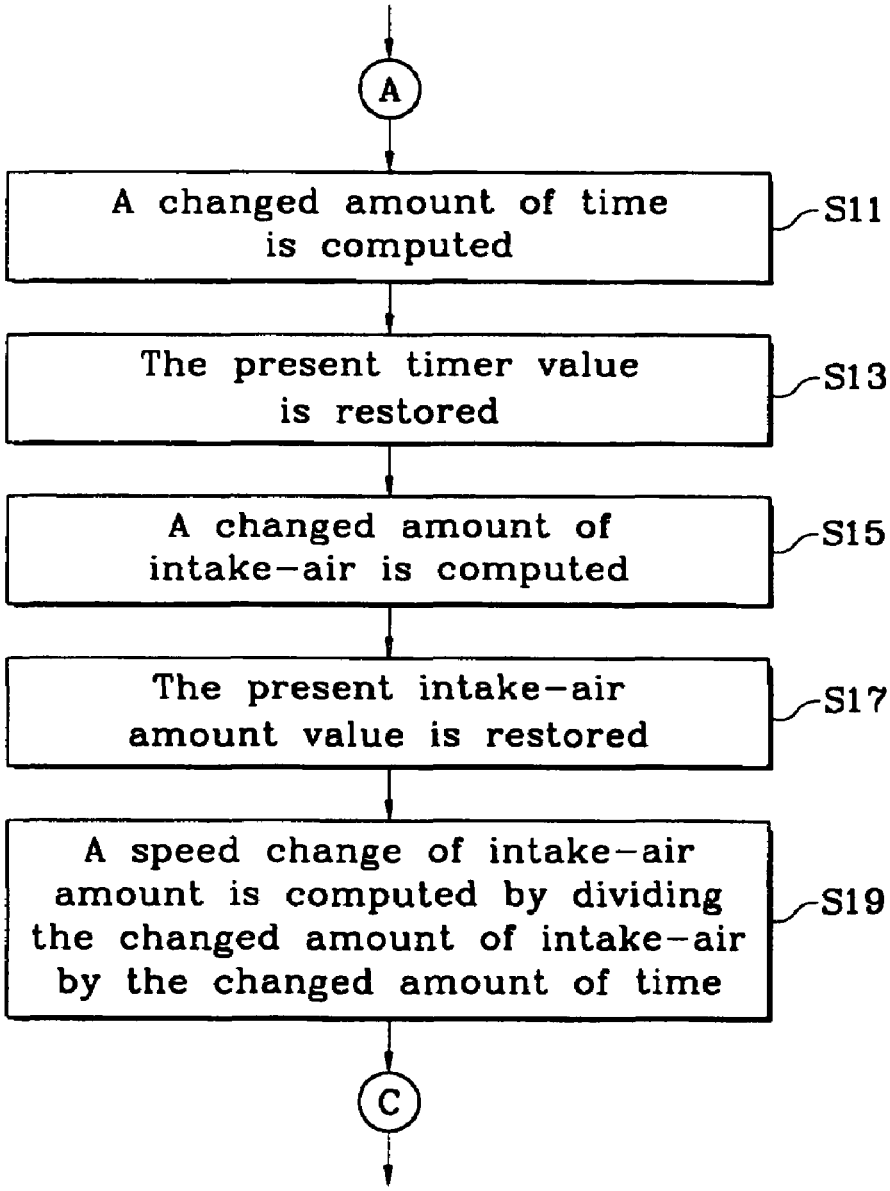
FIG. 2 is a flowchart of a method for computing a speed change of an intake-air amount of FIG. 1.

Calculation of the speed change of the intake-air amount, which is depicted in step 4 of FIG. 1, is performed in the order described in FIG. 2. A changed amount of time (Delta_Time) is computed (S11) by subtracting a previous timer value (Timer_Old) from a present timer value (Timer) and then multiplying it by a time conversion constant (Time_Constant). The present timer value (Timer) is stored in a memory, at step (S13). A changed amount of intake-air (Delta_Charge) is computed by subtracting a previously measured intake-air amount value (Charge_Old) from a present intake-air amount value (Charge) measured by the AFS, at step (S15). The present intake-air amount value (Charge) is stored in a memory (S17). The speed change of intake-air amount (D_Charge) is computed by dividing the changed amount of intake-air (Delta_Charge) by the changed amount of time (Delta_Time), at step (S19).

Figure 3:
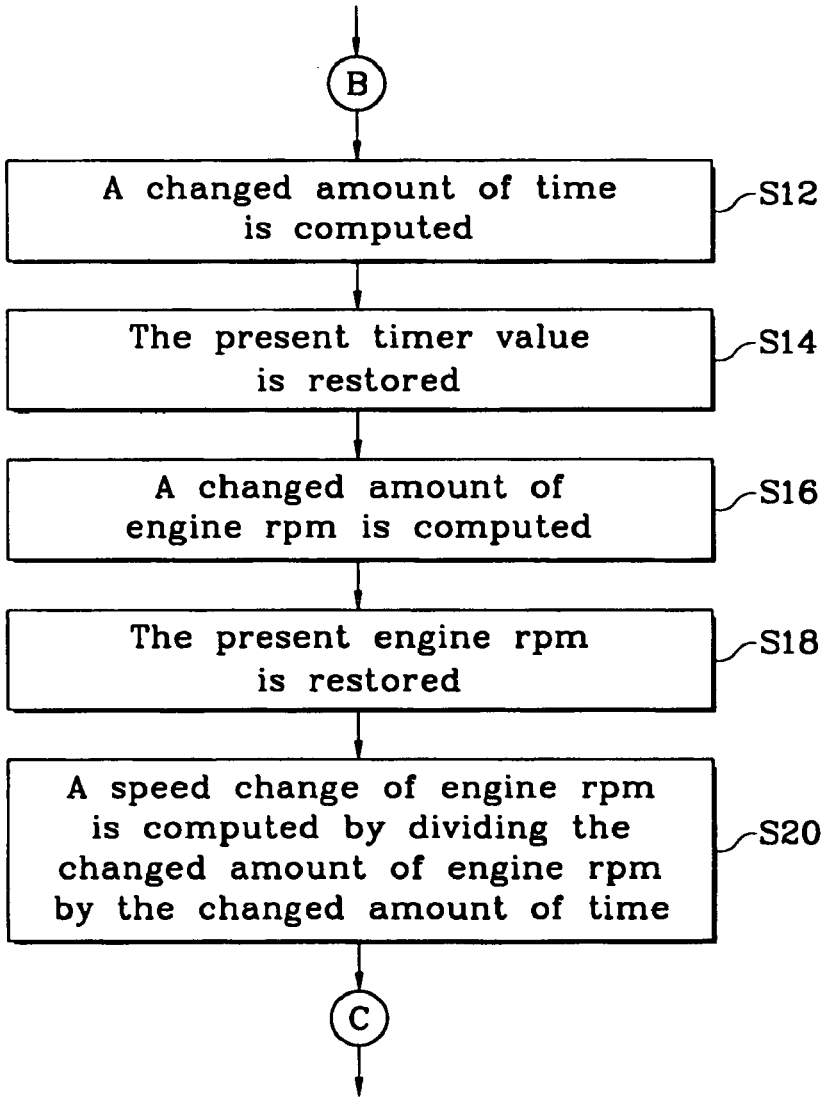
FIG. 3 is a flowchart of a method for computing a speed change of an engine rpm of FIG. 1.

According to an embodiment of the present invention, a calculation method for the speed change of the engine rpm, depicted in step 2 of FIG. 1, is performed in the order described in FIG. 3. A changed amount of time (Delta_Time) is computed (S12) by subtracting a previous timer value (Timer_Old) from a present timer value (Timer) and then multiplying it by a time conversion constant (Time_Constant). The present timer value (Timer) is stored in a memory (S14). A changed amount of the engine rpm (Delta_RPM) is then computed at step (216) by subtracting a previous engine rpm (RPM_Old) from a present engine rpm (RPM) measured via the crank sensor. The present engine rpm (RPM) is stored in a memory, at step (S18). The speed change of engine rpm (D_RPM) is computed by dividing the changed amount of the engine rpm (Delta_RPM) by the changed amount of time (Delta_Time), at step (S20).

Figure 4:
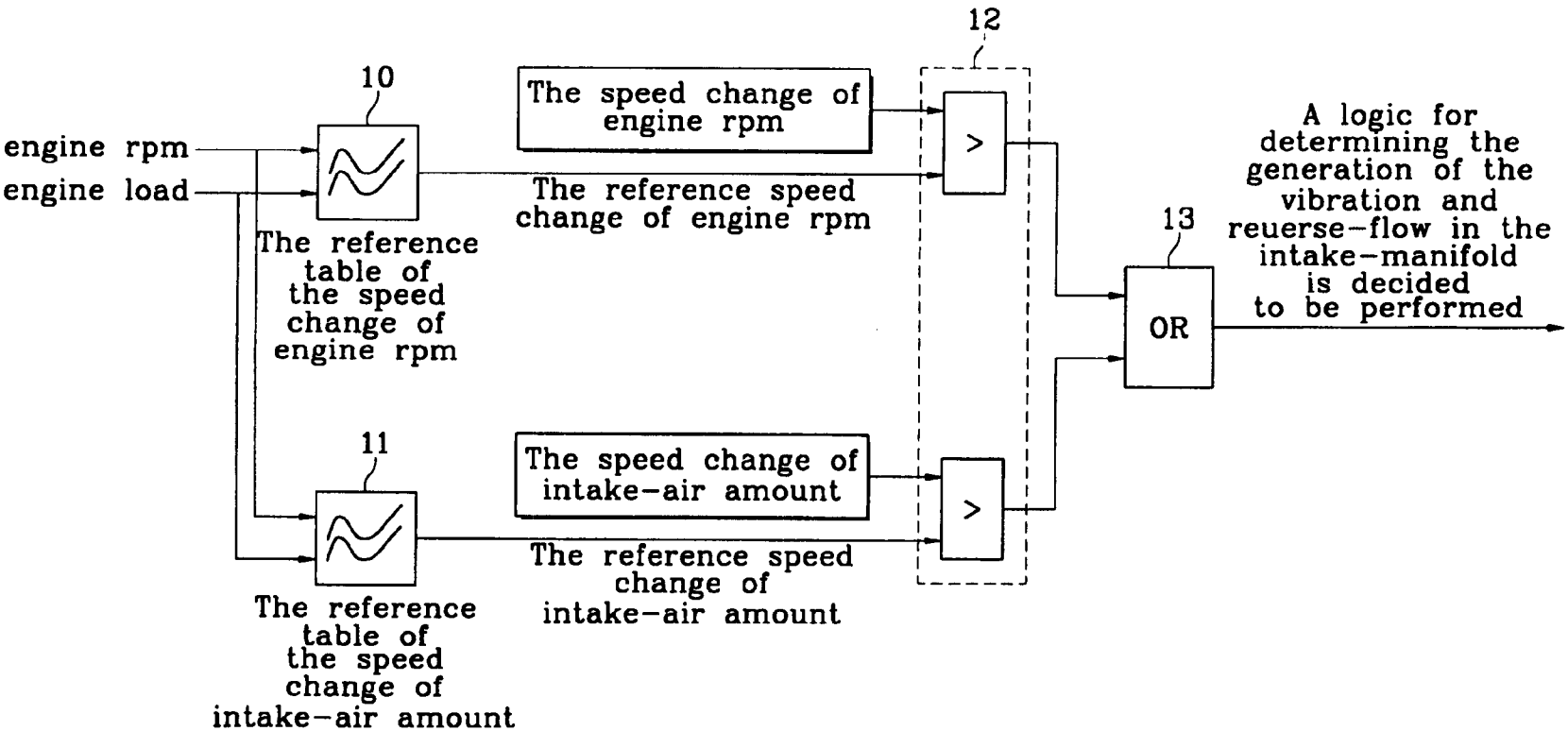
FIG. 4 is a block diagram of a logic that determines whether diagnosis for generation of a vibration and reverse-flow in an intake manifold of FIG. 1 is required.

Referring now to FIG. 4, in order to determine whether the diagnosis for the generation of the vibration and reverse-flow in the intake manifold according to the driving state of an engine is required, a reference speed change of the engine rpm according to the engine rpm and engine load is calculated on the basis of a pre-saved reference table 10 of the speed change of engine rpm. Next, the above reference speed change of the engine rpm is compared in a comparator 12 with the speed change of the engine rpm computed in FIG. 2. Likewise, in order to determine whether the diagnosis for the generation of the vibration and reverse-flow in the intake manifold according to the driving state of an engine is required, the speed change of the intake-air amount computed in FIG. 3 is compared, on the basis of a pre-saved reference table 11 of the speed change of intake-air amount, in comparator 12 with a reference speed change of the intake-air amount according to the engine rpm and engine load. Next, whether the diagnosis of the generation of the vibration and reverse-flow in the intake manifold will be performed is determined according to the result of the logical sum of each of the above comparisons in an OR logic 13. Thus, when the speed change of the engine rpm or the speed change of the intake-air amount exceeds the reference value, the determination logic for the generation of the vibration and reverse-flow in the intake manifold is executed.

According to an embodiment of the present invention, the logic of FIG. 4 is performed because performing the determination logic for the generation of the vibration and reverse-flow at all times is inefficient to the function of the engine controller. Therefore, the allowable speed change of the engine rpm and the speed change of the intake-air amount per each engine operation region are pre-set in tables. If the speed change of the engine rpm or the speed change of the intake-air amount is generated at the substantial present engine operation range, the intake-air amount measured via the AFS is preferably used in place of performing the determination logic for the generation of the vibration and reverse-flow in the intake manifold.

Figure 5:
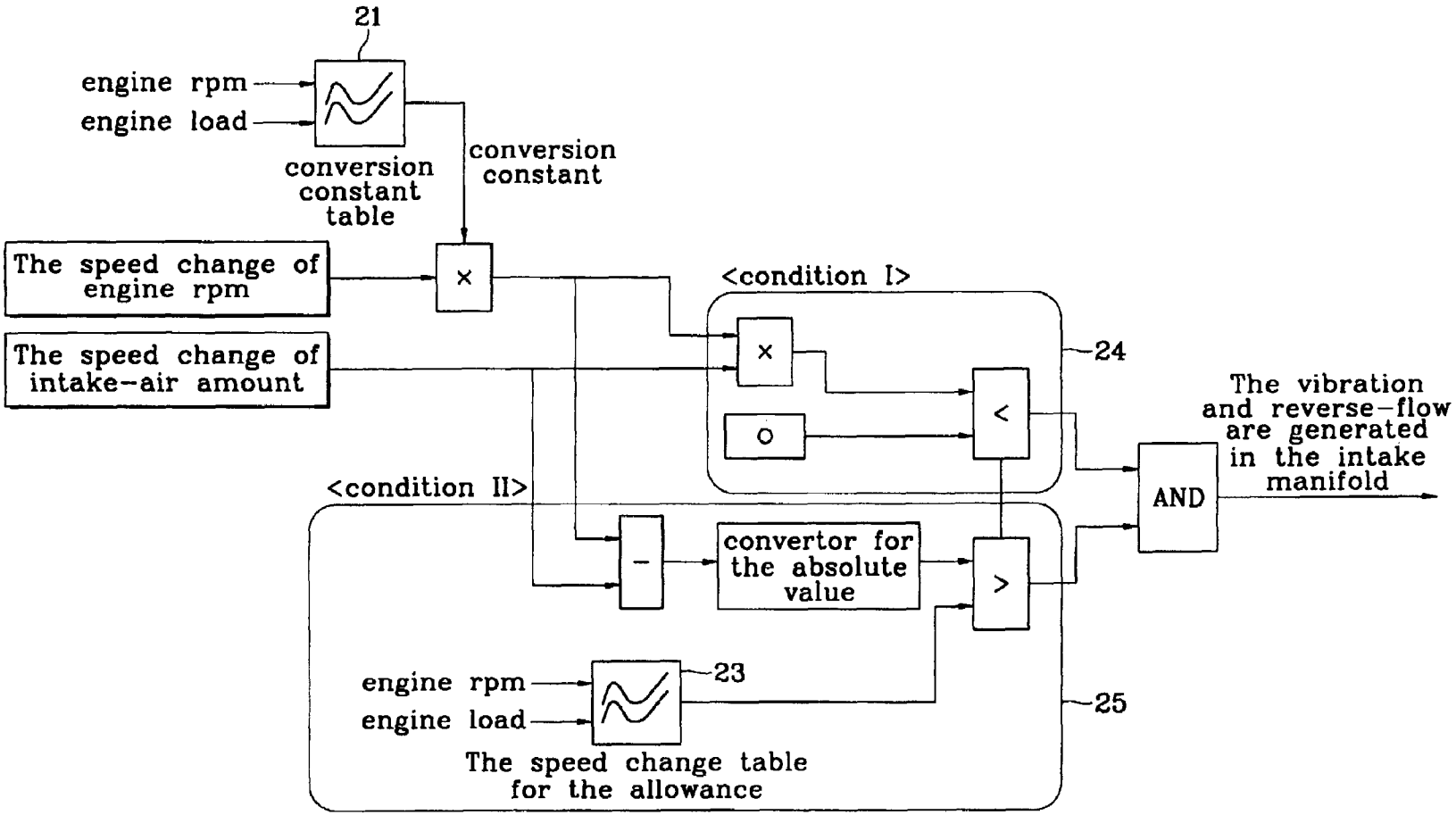
FIG. 5 is a block diagram of a logic for determining generation of vibration and reverse-flow in an intake manifold of FIG. 1.

Referring now to FIG. 5, as per a first condition logic 24 of determining the generation of the vibration and reverse-flow in the intake manifold, it is determined whether a negative value is obtained, on the basis of a conversion constant table 21, when the speed change of the engine rpm is multiplied by a conversion constant that converts the speed change of the engine rpm into the speed change of the intake-air amount according to the driving state of an engine and then is multiplied by the speed change of the intake-air amount. If the above multiplied value is negative, then the directions of the speed change of the engine rpm and the speed change of the intake-air amount are assumed to be opposite to each other and the vibration and reverse-flow are determined to occur in the intake manifold. According to a second condition logic 25 of determining whether the vibration and reverse-flow are generated in the intake manifold, an absolute value is obtained by subtracting the speed change of the intake-air amount from the multiplication of the engine rpm with a conversion constant. Then, the absolute value is compared with an allowance value of the speed change of the engine rpm and the speed change of the intake-air amount according to the driving state of an engine. If the absolute value is larger than the allowance value, the vibration and reverse-flow are determined to be generated in the intake manifold.

In case both first and second condition logics 24 and 25 are satisfied simultaneously, the vibration and reverse-flow are determined to occur in the intake manifold. However, although the speed change of the engine rpm and the speed change of the amount of intake-air are different from each other in the first condition, if the difference is small, then it is determined that no vibration and reverse-flow are generated in the second condition.

The credible range of the AFS limited by the vibration or reverse-flow of the intake-air is measured by the change rate of the AFS and change rate of the engine speed. The air amount is calculated only at the region where the vibration is generated. In the regions without vibration, the signal of the AFS is used, thereby enabling to increase the range using the AFS and improving the accuracy of determining the credible range of the AFS.

As apparent from the foregoing description of the present invention, there is an advantage in that the accuracy for determining the reliable range of the AFS in determining the amount of fuel to be injected is improved. Further, the range in which the fuel injection amount is determined by using the AFS can be increased.

What is claimed is:

1. A method for determining the amount of fuel injection in an engine system having a crank sensor and airflow sensor, comprising the steps of:

computing a speed change of engine revolutions per minute by detecting said engine revolutions per minute from a crank sensor;

computing a speed change of an intake-air amount by detecting said intake-air amount from an airflow sensor;

comparing the speed change of said engine revolutions per minute and the speed change of said intake-air amount with reference values, respectively, and then deciding whether a diagnosis of generation of vibration and reverse-flow in an intake manifold is required;

if diagnosis for generation of the vibration and reverse-flow in said intake manifold is decided to be performed, executing a pre-established logic for determining the vibration and reverse-flow and then deciding whether the vibration and reverse-flow are generated in said intake manifold;

if the vibration and reverse-flow are determined to occur in said intake manifold, correcting said intake-air amount, which is restored before the generation of the vibration and reverse-flow, in response to a present engine speed and computing a present intake-air amount; and deciding a fuel injection amount by using the above computed intake-air amount instead of using said intake-air amount measured by said airflow sensor.

2. The method as defined in claim 1, further comprising; if it is determined that no vibration and reverse-flow occur in said intake manifold, then determining a fuel injection amount by using a value measured via said airflow sensor.

3. The method as defined in claim 1, further comprising the step of:

if the speed change of said engine revolutions per minute or the speed change of said intake-air amount exceeds a pre-established relevant reference value, then determining whether the vibration and reverse-flow are generated in said intake manifold.

4. The method as defined in claim 3, wherein the speed change of said engine revolutions per minute is calculated by:

computing a changed amount of time by subtracting a previous timer value from a present timer value to obtain a result and then multiplying the result by a time conversion constant;

restoring said present timer value as said previous timer value;

computing a changed amount of said engine revolutions per minute by subtracting a previous engine revolutions per minute from a present engine revolutions per minute measured from said crank sensor;

restoring said present engine revolutions per minute to said previous engine revolutions per minute; and computing a speed change of said engine revolutions per minute by dividing said changed amount of engine revolutions per minute by the changed amount of time.

5. The method as defined in claim 3, wherein the speed change of said intake-air amount is calculated by:

computing a changed amount of time by subtracting a previous timer value from a present timer value to obtain a result and then multiplying the result by a time conversion constant;

restoring said present timer value to said previous timer value;

computing a changed amount of said intake-air by subtracting a previously measured intake-air amount value from a present intake-air amount value measured via said airflow sensor;

restoring said present intake-air amount value as said previous intake-air amount value; and computing a speed change of said intake-air amount by dividing said changed amount of intake-air by the changed amount of time.

6. The method as defined in claim 1, wherein whether the diagnosis for the generation of the vibration and reverse-flow in said intake manifold is required is decided in the steps of:

comparing, on a basis of a pre-saved reference table of the speed change of said engine revolutions per minute, the above computed speed change of said engine revolutions per minute with a reference speed change of engine revolutions per minute according to said engine revolutions per minute and an engine load;

comparing, on a basis of a pre-saved reference table of the speed change of said intake-air amount, the above computed speed change of said intake-air amount with a reference speed change of said intake-air amount according to said engine revolutions per minute and an engine load; and deciding whether the diagnosis of generation of the vibration and reverse-flow in said intake manifold is required according to a result of a logical sum of each above comparison.

7. The method as defined in claim 1, wherein the determination of the generation of the vibration and reverse-flow in said intake manifold is performed in the steps of:

determining whether a negative value is obtained when the speed change of said engine revolutions per minute is multiplied by a conversion constant that converts the speed change of said engine revolutions per minute into a speed change of said intake-air amount according to a driving state of an engine and then multiplying the value by the speed change of said intake-air amount;

calculating an absolute value by subtracting the speed change of said intake-air amount from the multiplication of the speed change of said engine revolutions per minute with said conversion constant;

comparing the above absolute value with an allowance value of the speed change of said engine revolutions per minute and the speed change of said intake-air amount according to the driving state of an engine; and if the above multiplied value is a negative value and the absolute value is larger than the allowance value, then determining that vibration and reverse-flow are generated in said intake manifold.

* * * * *